US007369800B2

(12) United States Patent
Izumi et al.

(10) Patent No.: US 7,369,800 B2
(45) Date of Patent: May 6, 2008

(54) DEVICE FOR PREVENTING CONTACT BETWEEN TRANSFER BODY AND TRANSFER MEDIUM TAIL EDGE PORTION IN IMAGE FORMING APPARATUS

(75) Inventors: Hideshi Izumi, Nara (JP); Susumu Murakami, Kyoto (JP); Minoru Tomiyori, Kyoto (JP); Tomohiko Fujii, Nara (JP); Yoshie Iwakura, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 258 days.

(21) Appl. No.: 11/084,246

(22) Filed: Mar. 21, 2005

(65) Prior Publication Data

US 2005/0207802 A1 Sep. 22, 2005

(30) Foreign Application Priority Data

Mar. 22, 2004 (JP) ..... 2004-082757

(51) Int. Cl.
*G03G 15/16* (2006.01)
*G03G 15/00* (2006.01)

(52) U.S. Cl. ..... 399/317; 399/400

(58) Field of Classification Search ..... 399/316, 399/317, 400, 406

See application file for complete search history.

(56) References Cited

U.S. PATENT DOCUMENTS 4,693,587 A * 9/1987 Shigenobu et al. ..... 399/339
4,876,576 A * 10/1989 Itaya et al. ..... 399/322
5,130,752 A * 7/1992 Morishita et al. ..... 399/315
5,434,658 A * 7/1995 Kwon ..... 399/328
5,758,247 A * 5/1998 Yanashima et al. ..... 399/384
5,771,434 A * 6/1998 Hokari ..... 399/400
6,070,049 A * 5/2000 Hayashida ..... 399/400
6,108,514 A * 8/2000 Nakayama et al. ..... 399/400
6,661,989 B2 * 12/2003 Pitts et al. ..... 399/322
6,678,494 B2 * 1/2004 Kida et al. ..... 399/316

FOREIGN PATENT DOCUMENTS

JP 5-6116 A 1/1993
JP 10-10875 A 1/1998
JP 10301346 A * 11/1998
JP 2001-130784 5/2001
JP 2002-278310 A 9/2002
JP 2002328552 A * 11/2002
JP 2004-012926 1/2004

* cited by examiner

*Primary Examiner*—Robert Beatty
(74) *Attorney, Agent, or Firm*—Birch, Stewart, Kolasch & Birch, LLP

(57) ABSTRACT

An image forming apparatus is constituted so as to be equipped with transfer apparatus(es) having transfer roller (s) electrostatically transferring development image(s) from photosensitive drum(s) to transfer medium/media, and so as to be provided with transfer medium guide unit disposed downstream in transfer medium transport path(s) from location(s) at which photosensitive drum(s) oppose transfer roller(s), and such that transfer medium guide location(s) of transfer medium guide means is/are variable.

16 Claims, 5 Drawing Sheets

Shown in second position

FIG.2 (a) Shown in first position
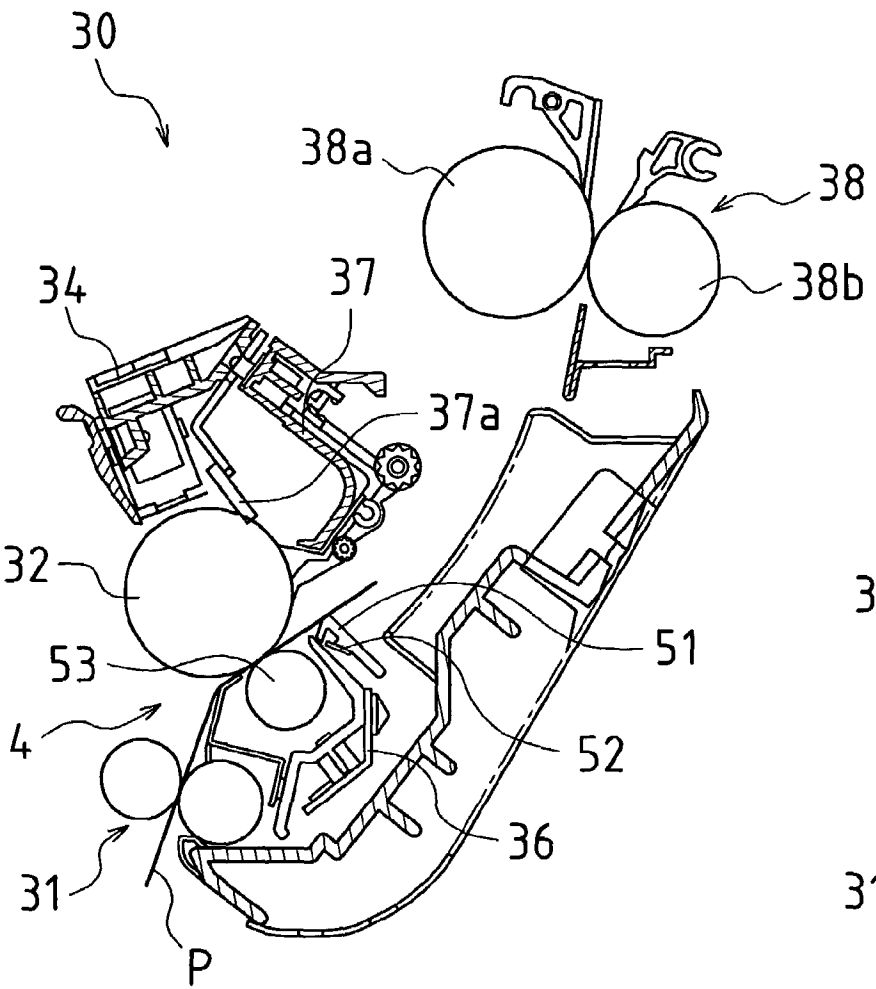
FIG.2 (b) Shown in second position
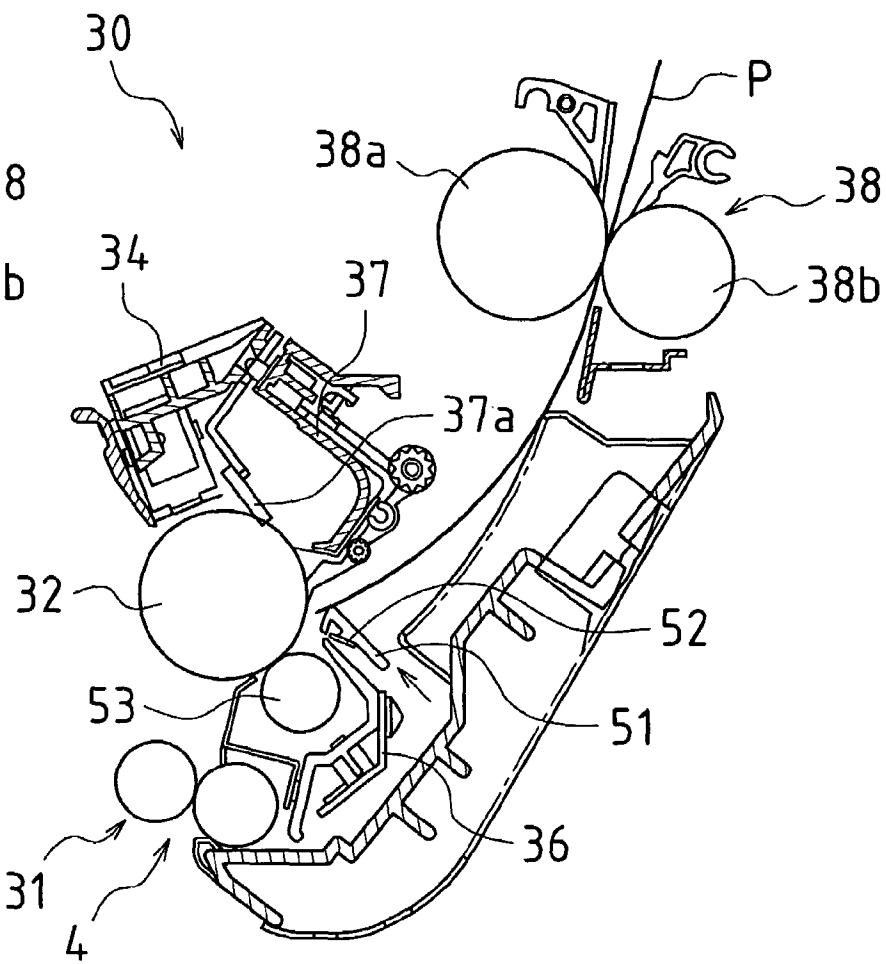

FIG.5 (a) Shown in first position

FIG.5 (b) Shown in second position

DEVICE FOR PREVENTING CONTACT BETWEEN TRANSFER BODY AND TRANSFER MEDIUM TAIL EDGE PORTION IN IMAGE FORMING APPARATUS

This application claims priority under 35 USC 119(a) to Patent Application No. 2004-82757 filed in Japan on 22 Mar. 2004, the content of which is hereby incorporated herein by reference in its entirety.

BACKGROUND OF INVENTION

The present invention relates to a copier, printer, facsimile machine, or other such image forming apparatus employing electrophotographic image forming method(s); more particularly, the present invention pertains to an image forming apparatus equipped with transfer apparatus(es) transferring, onto transfer medium/media, development image(s) formed on image carrier(s).

In an image forming apparatus employing an electrophotographic photosensitive body (hereinafter "photosensitive body") as image carrier, the surface of the photosensitive body is first uniformly charged by a charging apparatus, and the surface of the photosensitive body is then exposed by an optical write device to form a an electrostatic latent image. At a development apparatus, the electrostatic latent image is then developed by means of developer (toner), and at a transfer apparatus, the electrostatic latent image is transferred onto transfer medium/media (e.g., recording paper) that has been transported thereto; following which, the electrostatic latent image is fused onto transfer media by means of a fusing apparatus and is provided to a user or the like as media on which an image has been formed.

Transfer methods in which transfer roller(s), transfer brush(es), transfer block(s), and/or other such transfer body or bodies is/are pressed against and/or is/are brought in proximity to photosensitive body surface(s) have in recent times frequently come to be employed during transfer operation(s) in which development image(s) (toner image(s)) is/are transferred. This is because such methods are among those which are more considerate of the environment in that ozone emissions are generally reduced as compared with conventional electrostatic transfer methods making use of electric discharge from a corona discharge wire.

However, when employing the aforementioned transfer methods in which transfer roller(s), transfer brush(es), transfer block(s), and/or other such transfer body or bodies is/are brought in proximity to and/or is/are pressed against photosensitive body surface(s), spatial tolerances for transport of transfer medium/media are reduced, requiring increased transport accuracy, as compared with conventional electrostatic transfer methods employing corona discharge wire.

That is, unless transport accuracy is increased, this will invite problems in which transfer medium/media deviate from transport path(s), increasing likelihood of contact with nearby component(s) and/or transfer medium/media fold and/or jam, as well as problems in which development image(s) on transfer medium/media is/are disturbed as a result of contact and/or in which residual toner remaining on photosensitive body surface(s) and/or toner that has been scattered thereabout and/or the like adheres to transfer body surface(s), adversely affecting transfer action. Moreover, due to the fact that a wide variety of circumstances can be envisioned with respect to ambient conditions such as humidity and the like as well as transfer medium stiffness and so forth, there would be difficulty in achieving proper transport over a broad range of conditions.

As one specific example, after the trail edge portion of the transfer medium has passed through the region at which the photosensitive body opposes the transfer body, it is possible that the trail edge portion of the transfer medium will press against or come in contact with the surface of the transfer body and that toner will adhere to the transfer body. If the trail edge portion of a subsequent transfer medium similarly presses against or comes in contact with the transfer body, then toner adhering to the transfer body can adhere to the trail edge portion of the subsequent transfer medium. And there has been the problem that when fusing of the transfer medium takes place with toner adhering to the trail edge portion thereof, the trail edge portion of the transfer medium becomes dark and soiled.

Image forming apparatuses have therefore been proposed, for example, in which the trail edge portion of the transfer medium is prevented from coming in contact with the transfer body as a result of provision of transfer medium guide member(s) downstream in the transfer medium transport direction from the transfer body (see, e.g., Japanese Patent Application Publication Kokai No. 2002-278310).

However, the image forming apparatus indicated in the aforementioned Japanese Patent Application Publication Kokai No. 2002-278310 has had problems such as the following. Where attempts have been made to provide transfer medium guide member(s) at location(s) such as would permit sufficient distance to be maintained between the photosensitive body and the trail edge portion of the transfer medium, there has been the problem that the transfer medium is improperly guided as the lead edge portion of the transfer medium is made to advance toward the fusing operation which is subsequent thereto, impairing ability to achieve proper transfer medium transport characteristics. In contrast, where attempts have been made to ensure proper transport medium transport characteristics, there has been the problem that it has not been possible to maintain sufficient distance between the photosensitive body and the trail edge portion of the transfer medium, meaning that there has been inadequate effect with respect to prevention of soiling of the trail edge portion of the transfer medium.

The present invention was conceived in light of the foregoing problems in the conventional art, it being an object thereof to adequately ensure proper transfer medium transport characteristics and completely prevent contact between photosensitive body or bodies and transfer medium trail edge portion(s), and to therefore provide an image forming apparatus permitting satisfactory image formation.

SUMMARY OF INVENTION

The present invention may employ one or more of the constitutions indicated below to solve one or more of the foregoing and/or other problems.

An image forming apparatus in accordance with one or more embodiments of the present invention may comprise one or more transfer means having one or more transfer bodies electrostatically transferring one or more development images (toner images) from one or more image carriers to one or more transfer media; and one or more transfer medium guide means disposed downstream in at least one transfer medium transport path from one or more locations at which at least one of the image carrier or carriers opposes at least one of the transfer body or bodies; wherein at least one transfer medium guide location of at least one of the transfer medium guide means is variable.

As a result of adoption of such a constitution, it will be possible, during transport of transfer medium/media following transfer operation(s), to vary transport path(s) of lead edge portion(s) of transfer medium/media and transport path(s) of trail edge portion(s) of transfer medium/media, making it possible to simultaneously achieve proper transfer medium transport as well as prevention of soiling by toner of trail edge portion(s) of transfer medium/media.

In the foregoing constitution, at least one of the transfer medium guide means may be capable of being selectively switched between a first position permitting at least one lead edge portion of at least one of the transfer medium or media to be guided therealong when the at least one transfer medium lead edge portion passes therethrough and a second position permitting at least one trail edge portion of at least one of the transfer medium or media to be raised upward when the at least one transfer medium trail edge portion passes therethrough.

As a result of adoption of such a constitution, it will be possible for lead edge portion(s) of transfer medium/media, after having undergone transfer operation(s), to be made to smoothly advance to fusing operation(s) which is/are subsequent thereto, and it will furthermore be possible to achieve a situation in which trail edge portion(s) of transfer medium/media do not come in contact with transfer body/bodies, and it will therefore be possible to obtain satisfactory image(s) which is/are unsoiled by toner.

The foregoing constitution may further comprise one or more fusing means, disposed downstream in at least one transport path from at least one of the transfer medium guide means, for fusing at least one of the development image or images electrostatically transferred to at least one of the transfer medium or media; and switching from the first position of at least one of the transfer medium guide location or locations of at least one of the transfer medium guide means to the second position thereof may take place after at least the lead edge portion of at least one of the transfer medium or media enters at least one of the fusing means.

As a result of adoption of such a constitution, because switching of transfer medium guide location(s) may be carried out after lead edge portion(s) of transfer medium/media has or have advanced to fusing operation(s) which follow transfer operation(s), it is possible to achieve a situation in which transfer medium transport characteristics are not impaired despite the fact that switching of transfer medium guide location(s) may take place, and it is therefore possible to prevent occurrence of jam(s), wrinkle(s), and/or other such problematic situations that might otherwise arise during transfer medium transport.

In the foregoing constitution, at least one of the transfer medium guide means may be equipped with one or more charge removal means for removing charge from at least one of the transfer medium or media.

As a result of adoption of such a constitution, it will be possible to achieve a situation in which distance to the charge removal means from the transfer medium/media which is/are guided by the transfer medium guide means remains constant regardless of whether the transfer medium guide means is in the first position or the second position, making it possible for charge remaining on transfer medium/media to be uniformly removed over the entire expanse thereof.

In the foregoing constitution, at least one of the transfer medium guide means may be such that one or more ribs (projections) are formed thereon at least at one or more regions coming in contact with at least one of the transfer medium or media.

As a result of adoption of such a constitution, even if back surface(s) of transfer medium/media that have undergone transfer operation(s) come in contact with the transfer medium guide means, there being no soiling thereof by toner, it will be possible to carry out satisfactory image formation without soiling of back(s) of transfer medium/media.

In the foregoing constitution, in correspondence to at least one width of at least one of the transfer medium or media in at least one direction perpendicular to at least one direction of transport of at least one of the transfer medium or media, there may be a plurality of the ribs formed on at least one of the transfer medium guide means, and at least a portion of the plurality of ribs may be arranged along one or more directions parallel to at least one width direction of at least one of the transfer medium or media.

Adoption of such a constitution will make it possible to definitively guide and support the transfer medium/media along the full width(s) thereof as it/they is/are transported along transport path(s).

In the foregoing constitution, at least a portion of the plurality of ribs formed on at least one of the transfer medium guide means may be provided at locations corresponding to at least one region in the vicinity of the central portion of, and at least one region in the vicinity of each of the two ends in at least one width direction of, at least one of the transfer medium or media; and at least a portion of the plurality of ribs may be arranged so as to occupy different heights in at least one transfer medium thickness direction.

Adoption of such a constitution makes it possible, by addressing deflection (bowing) of transfer medium/media as it passes therethrough between the image carrier(s) and the transfer body/bodies, to impart stiffness to transfer medium/media and to more easily guide and support transfer medium/media along the full expanse(s) thereof.

In the foregoing constitution, at least one of the transfer medium guide means may be such that at least one or more regions coming in contact with at least one of the transfer medium or media is or are formed from one or more electrically conductive materials.

Adoption of such a constitution makes it possible to stably guide and support transfer medium/media without accumulation of charge at the transfer medium guide means due to friction between same and back surface(s) of transfer medium/media, and makes it possible to prevent adverse effect on development image(s) (toner image(s)) which is/are electrostatically supported on transfer medium/media as a result of accumulation of charge.

In the foregoing constitution, at least one of the transfer medium guide means may be such that at least one or more regions coming in contact with at least one of the transfer medium or media is or are formed from one or more resin materials having triboelectric characteristics substantially identical to at least one charge polarity of at least one of the toner or toners.

As a result of adoption of such a constitution, even if charge accumulates at the transfer medium guide means due to friction between same and back surface(s) of transfer medium/media, because charge polarity or polarities thereof will be the same as that or those of toner(s), toner(s) will not be made to adhere electrostatically thereto and it will therefore be possible to carry out satisfactory image formation without soiling of back(s) of transfer medium/media.

In the foregoing constitution, at least one of the transfer medium guide means may have, at one or more locations coming in contact with at least one of the transfer medium or media, at least one rotating body capable of rotation about at least one axis substantially parallel to at least one transfer medium width direction perpendicular to at least one transfer medium transport direction.

As a result of adoption of such a constitution, because the rotating body/bodies pressing against back surface(s) of transfer medium/media rotate in idler fashion in coordination with downstreamwardly directed transport of transfer medium/media in the transport path(s), it is possible to achieve a situation in which friction between same and transfer medium/media is low, permitting transfer medium/media to be smoothly guided and supported as transfer medium/media travels in downstreamwardly directed fashion in the transport path(s).

In the foregoing constitution, at least one of the rotating body or bodies may comprise one or more disk-shaped first rotating bodies; and one or more second rotating bodies having a plurality of cuspate features present in at least one cross-sectional profile in at least one direction perpendicular to at least one rotatable shaft; and at least one of the first rotating body or bodies and at least one of the second rotating body or bodies may be rotatable; may be formed in integral fashion; and may be capable of rotation about at least one axis substantially parallel to at least one transfer medium width direction perpendicular to at least one transfer medium transport direction.

As a result of adoption of such a constitution, it will be possible to minimize any damage to lead edge portion(s) of transfer medium/media occurring when lead edge portion(s) of transfer medium/media first impact the rotating body/bodies; and furthermore, when rotating body/bodies act on back surface(s) of transfer medium/media to guide transfer medium/media in downstreamwardly directed fashion in the transport path(s), it will be possible to minimize contact area over which the rotating body/bodies act on back surface(s) of transfer medium/media, permitting transfer medium/media to be smoothly guided and supported. Moreover, forming the first rotating body/bodies and the second rotating body/bodies in integral fashion such that cuspate portion(s) of the second rotating body/bodies engage appropriately will facilitate rotation and will discourage generation of friction; and furthermore, circumferential end portion(s) of the first rotating body/bodies will make it possible to avoid problematic situations in which transfer medium/media or the like slips between plurality or pluralities of cuspate portions of the second rotating body/bodies.

In the foregoing constitution, in correspondence to at least one width of at least one of the transfer medium or media in at least one direction perpendicular to at least one direction of transport of at least one of the transfer medium or media, there may be a plurality of the rotating bodies arranged along one or more directions parallel to at least one width direction of at least one of the transfer medium or media.

Adoption of such a constitution will make it possible to definitively guide and support the transfer medium/media along the full width(s) thereof as it/they is/are transported along transport path(s).

In the foregoing constitution, at least a portion of the plurality of rotating bodies may be provided at locations corresponding to at least one region in the vicinity of the central portion of, and at least one region in the vicinity of each of the two ends in at least one width direction of, at least one of the transfer medium or media; and at least a portion of the plurality of rotating bodies may be arranged so as to occupy different heights in at least one transfer medium thickness direction.

Adoption of such a constitution makes it possible, by addressing deflection (bowing) of transfer medium/media as it passes therethrough between the image carrier(s) and transfer body/bodies, to impart stiffness to transfer medium/media and to more easily guide and support transfer medium/media along the full expanse(s) thereof.

In the foregoing constitution, at least one of the rotating body or bodies may be formed from one or more electrically conductive materials.

Adoption of such a constitution makes it possible to stably guide and support transfer medium/media without accumulation of charge at transfer medium guide means due to friction between same and back surface(s) of transfer medium/media, and makes it possible to prevent adverse effect on development image(s) (toner image(s)) which is/are electrostatically supported on transfer medium/media as a result of accumulation of charge.

In the foregoing constitution, at least one of the transfer medium guide means may be equipped with one or more charge removal means for removing charge from at least one of the transfer medium or media; and at least one of the rotating body or bodies may be formed from one or more insulating resin materials.

As a result of adoption of such a constitution, even if the rotating body/bodies and the charge removal means are disposed in mutually proximate fashion, it will be possible to achieve a situation in which there is no charge removal effect on transfer medium/media following separation thereof, and it will therefore be possible to prevent adverse effect on development image(s) (toner image(s)) which is/are electrostatically supported on transfer medium/media.

In the foregoing constitution, at least one of the rotating body or bodies may be formed from one or more resin materials having triboelectric characteristics substantially is identical to at least one charge polarity of at least one of the toner or toners.

As a result of adoption of such a constitution, even if charge accumulates at the rotating body/bodies due to friction between same and back surface(s) of transfer medium/media, because charge polarity or polarities thereof will be the same as that or those of toner(s), toner(s) will not be made to adhere electrostatically thereto and it will therefore be possible to carry out satisfactory image formation without soiling of back(s) of transfer medium/media.

Due to the fact that the present invention may adopt constitution(s) such as the foregoing, because lead edge portion(s) of transfer medium/media, after having undergone transfer operation(s), can be smoothly guided to operation(s) which is/are subsequent thereto (e.g., the aforementioned fusing operation(s) and/or the like), and because it is possible to definitively prevent transfer body/bodies from coming in contact with trail edge portion(s) of transfer medium/media, it is possible to achieve a situation in which there is no occurrence of jam(s), wrinkle(s), and/or other such problematic situations that might otherwise arise during transfer medium transport and it is possible to prevent soiling by toner of trail edge portion(s) of transfer medium/media.

BRIEF DESCRIPTION OF DRAWINGS

FIG. 2 is an enlarged sectional view of the principal parts in the vicinity of a transfer apparatus associated with an embodiment of the present invention.

DETAILED DESCRIPTION OF THE INVENTION

Below, to aid in understanding the present invention, embodiments of the present invention are described with reference to the drawings. Note that the following embodiments are examples of specific implementations of the present invention and should not be construed as being of limiting nature with respect to the technical scope of the present invention.

First, referring to the sectional view of FIG. 1, an image forming apparatus 1 that is provided with transfer medium guide means associated with an embodiment of the present invention will be described. Image forming apparatus 1 has printing modes which include copier mode, printer mode, and fax mode; printing mode(s) corresponding to operations entered from an operation panel, not shown, or to receipt of a print job from a personal computer or other such external host apparatus might be selected by a controller, not shown.

Figure 1:
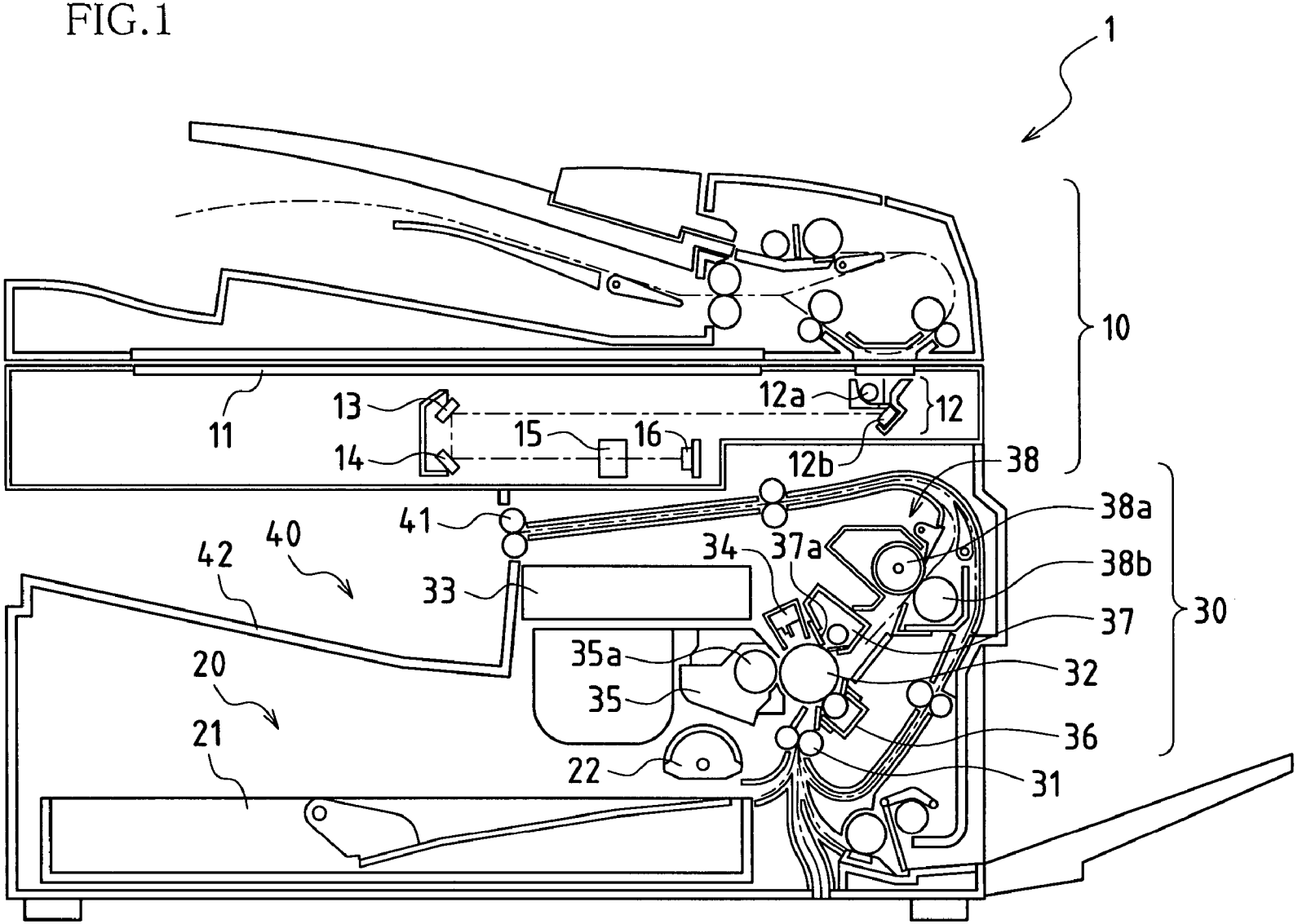
FIG. 1 is a sectional view of the entirety of an image forming apparatus associated with an embodiment of the present invention.

As shown in FIG. 1, image forming apparatus 1 may, broadly speaking, be understood to consist of original capturing unit (original capturing means) 10, media supply unit (media supply means) 20, printing unit (printing means) 30, and discharge unit 40; original capturing unit 10 being arranged above media supply unit 20, and discharge unit 40 being arranged at a location intermediate between original capturing unit 10 and media supply unit 20.

Description below will be carried out taking the example of copier mode, this being one of the aforementioned printing modes.

After original(s) is/are placed on glass platen 11 of original capturing unit (scanning unit) 10, a user might load transfer medium/media P (e.g., recording paper or other such sheet-like medium/media; see FIG. 2) in automatic-feed cassette 21 of media supply unit 20; and after carrying out input at a settings entry keypad (number of sheets or copies; printing magnification; etc.) at an operation panel (not shown) arranged at the front on the exterior of the apparatus main body, actuation of a start button at the operation panel might cause copy operations to begin.

Moreover, at original capturing unit 10, copy lamp (light source) 12*a* lights, and copy lamp unit 12 moves in the direction indicated by the arrow to begin exposure. Irradiated light from copy lamp 12*a* with which the original is irradiated becomes reflected light (light reflected from the original) containing original image information, and this reflected light travels from first mirror 12*b* provided at copy lamp unit 12 through second mirror 13, third mirror 14, optical lens 15 to CCD 16, as a result of which the original is captured.

Moreover, at original capturing unit 10, copy lamp (light source) 12*a* lights, and copy lamp unit 12 moves in the direction indicated by the arrow to begin exposure. Irradiated light from copy lamp 12*a* with which the original is irradiated becomes reflected light (light reflected from the original) containing original image information, and this reflected light travels from first mirror 12*b* provided at copy lamp unit 12 through second mirror 13, third mirror 14, optical lens 15 to CCD 16, as a result of which the original is captured.

Image information captured in such fashion enters a CCD circuit with which a controller, not shown, is provided, where the optical image information is converted to an electrical signal, the image information signal being subjected to image processing in accordance with established conditions and being sent to LSU unit 33 in the form of print data.

Furthermore, the entirety of photosensitive drum 32 is charged to a prescribed electrostatic potential by charging unit 34. Laser light from LSU unit 33 travels by way of polygonal mirror(s) and/or various lenses, not shown, to be irradiated onto photosensitive drum 32, and a electrostatic latent image is formed on photosensitive drum 32. Developer (toner) on MG roller(s) 35*a* within development tank 35 is then brought near the surface of photosensitive drum 32, and the electrostatic latent image is made manifest by toner in correspondence to the difference in electrostatic potential on photosensitive drum 32.

Furthermore, transfer medium P, on which images are to be formed, is transported in timed fashion toward photosensitive drum 32 by the registration rollers 31, and transfer apparatus ("transfer means" in the language of the present invention) 36 causes toner on photosensitive drum 32 to be transferred to transfer medium P. Toner remaining on photosensitive drum 32 is scraped off therefrom by cleaning blade 37*a* of the drum unit and is recovered by cleaning unit 37.

Furthermore, transfer medium P, after transfer of toner thereto, passes through upper hot roller 38*a* and lower hot roller 38*b* of fusing apparatus ("fusing means" in the language of the present invention) 38, where heat and pressure are applied thereto, and the unfused toner on transfer medium P being melted and fixed to transfer medium P, this is then discharged into discharge tray 42 by discharge roller(s) 41.

Referring to FIG. 2, the constitution in the vicinity of transfer apparatus 36 will next be described.

As shown in FIG. 2, transfer apparatus 36 is provided with transfer roller(s) 53, which serve as transfer body/bodies, which comprise rotating body/bodies, and which is/are arranged so as to press against or be proximate to the surface of photosensitive drum 32. The surface of photosensitive drum 32 and the surface of transfer roller 53 are in a particular positional relationship such that the toner image, i.e., development image, formed on photosensitive drum 32 is transferred to transfer medium P.

Transfer roller 53 comprises, for example, EPDM, urethane, and/or other such electrically conductive, elastic member(s) wrapped around a core comprising metallic material; and has, for example, an outside diameter of 14 to 20 mm and a hardness of 30 to 50 (Asker C). Note that transfer body/bodies is/are not limited to transfer roller(s) 53 comprising rotating body/bodies, but as described below may be transfer block(s) and/or transfer brush(es) arranged so as to press against and/or so as to be brought in proximity to surface(s) of photosensitive drum(s) 32.

Furthermore, at transfer medium transport path 4, transfer medium guide means 51, representing one manner of constituting the present invention, is provided downstream in the transport path of transfer medium P from the location (transfer region) at which photosensitive drum 32 opposes transfer roller 53; and moreover, transfer medium guide means 51 is provided with charge removal apparatus ("charge removal means" in the language of the present invention) 52 for removing charge from transfer medium P, onto which the toner image has been transferred, as transfer medium P is separated from photosensitive drum 32. For convenience of description, note that in the description which follows, the surface of transfer medium P which is nearer to photosensitive drum 32 and onto which the toner image formed on photosensitive drum 32 is transferred will be referred to as the "front" side thereof, and the side which is opposite thereto and which is nearer to transfer roller 53 will be referred to as the "back" side thereof.

As shown in FIG. 2, in image forming apparatus 1 constituted as described above, transfer medium P is transported from below (upstream) to above (downstream) by way of transfer medium transport path 4, being transported in such manner as to pass through the aforementioned transfer region. In addition, as transfer medium P is transported therethrough, the toner image formed on photosensitive drum 32 is transferred to transfer medium P, and as the back surface of transfer medium P is thereafter guided by transfer medium guide means 51 which is provided at a point downstream therefrom in the transport path, transfer medium P is transported to fusing apparatus 38 which is provided at a point still further downstream therefrom.

As transfer medium P is transported from the transfer region so as to pass therethrough, transfer medium guide means 51 acts on the back surface of transfer medium P from the lead edge portion thereof to the trail edge portion thereof, and moreover guides transfer medium P such that it is directed downstream in the transport path. Describing this in more detail, when the lead edge portion of transfer medium P advances to transfer medium guide means 51 after having passed through the transfer region, transfer medium guide means 51 is located in its first position (the position shown at FIG. 2 (*a*)), at which it is able to guide transfer medium P therealong so as to properly guide the lead edge portion of transfer medium P. Transfer medium P then advances further along the transport path; and when the trail edge portion of transfer medium P passes through the transfer region, transfer medium guide means 51 is located in its second position (the position shown at FIG. 2 (*b*)), at which it is able to raise transfer medium P upward. At this time, the trail edge portion of transfer medium P being lifted upward by transfer medium guide means 51, the trail edge portion of transfer medium P does not come in contact with transfer roller 53. As shown in FIG. 2, relative to the first position, the second position is shifted toward photosensitive drum 32 in more or less parallel fashion with respect to an imaginary line drawn between the axis of photosensitive drum 32 and the axis of transfer roller 53.

In addition, the transfer medium guide location of transfer medium guide means 51 is selectively switched by guide location altering means, not shown, so as to move back and forth between the first position and the second position. Guide location altering means may, for example, be constituted as follows. A spring or other such restoring force delivery means and a solenoid may be attached to transfer medium guide means 51, the restoring force from the spring causing transfer medium guide means 51 to move and be positioned in its second position when the solenoid is OFF, and the restoring force from the spring being overcome such that transfer medium guide means 51 is made to move and be positioned in its first position when the solenoid is ON. The solenoid would be switched ON and OFF such that the solenoid is switched ON, causing transfer medium guide means 51 to move to its first position, before the lead edge portion of transfer medium P arrives at transfer medium guide means 51 as it is transported therethrough from the transfer region; and such that the solenoid is switched OFF, causing transfer medium guide means 51 to move to its second position, after at least the lead edge portion of transfer medium P has entered fusing apparatus 38. Thus, when the transfer medium guide location of transfer medium guide means 51 is switched from its first position to its second position, the portion coming in contact with the back surface of transfer medium P at transfer medium guide means 51 is drawn away from transfer roller 53. Note that switching of transfer medium guide means 51 from its second position to its first position may take place after the trail edge portion of transfer medium P has passed through transfer medium guide means 51.

By thus adopting a constitution in which the transfer medium guide location of transfer medium guide means 51 is capable of being altered, because transfer medium P, after having undergone transfer operation(s), can be smoothly transported to operation(s) subsequent thereto (the fusing operation in the present embodiment) and because the trail edge portion of transfer medium P, after having undergone transfer operation(s), can be made to move away from transfer roller 53, preventing it from touching the surface of transfer roller 53, it is possible to completely prevent the trail edge portion of transfer medium P from being soiled due to toner adhering thereto. Furthermore, switching of the transfer medium guide location of transfer medium guide means 51 from its first position to its second position is carried out after at least the lead edge portion of transfer medium P has entered fusing apparatus 38. As a result, because switching of the transfer medium guide location from its first position to its second position is carried out after the lead edge portion of transfer medium P has advanced to the fusing operation which follows the transfer operation, it is possible to achieve a situation in which transfer medium transport characteristics are not impaired despite the fact that switching of the transfer medium guide location takes place, and it is therefore possible to prevent occurrence of jam(s), wrinkle(s), and/or other such problematic situations that might otherwise arise during transfer medium transport.

Furthermore, it will be possible to achieve a situation in which distance from transfer medium P, which is guided by transfer medium guide means 51, to the tip portion of charge removal apparatus 52, which is disposed between transfer roller 53 and transfer medium guide means 51, remains constant regardless of whether transfer medium guide means 51 is in its first position or its second position, making it possible for charge remaining on transfer medium P to be uniformly removed over the entire expanse thereof.

Moreover, ribs (projections) are formed on transfer medium guide means 51 at least at the portion thereof which comes in contact with transfer medium P. The shape thereof is suitable, being capable of reducing adherence to transfer medium P of toner adhering to transfer medium guide means 51.

Figure 3:
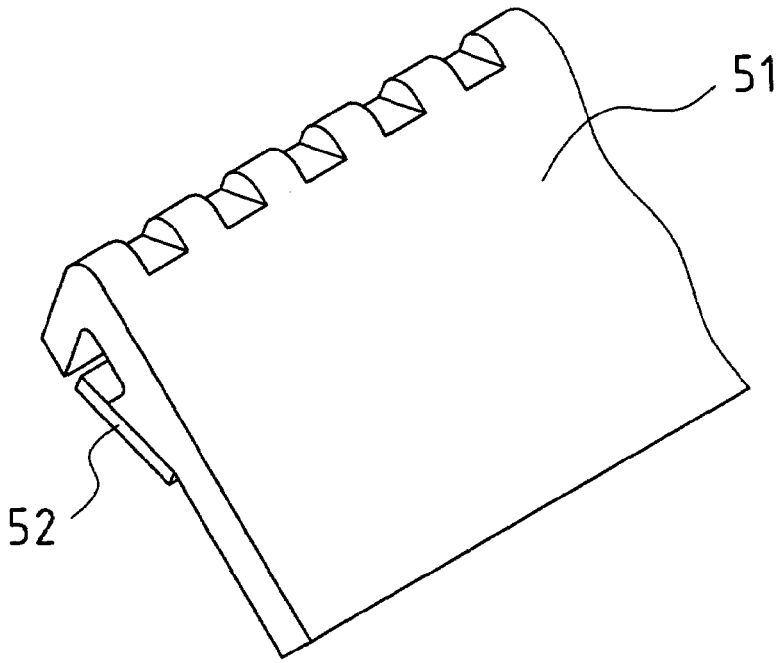
FIG. 3 is an oblique view showing a plurality of ribs formed on transfer medium guide means.

As shown in FIG. 3, in correspondence to the width dimension (width of transfer medium in direction perpendicular to direction of transport of transfer medium P) as determined by the size of transfer medium P which is transported therethrough, there are a plurality of such ribs formed on transfer medium guide means 51, the plurality of ribs being arranged in a direction parallel to the width dimension as determined by the size of this transfer medium P so as to permit transfer medium P to be definitively guided and supported regardless of the width dimension of transfer medium P as determined by the size thereof.

Figure 4:
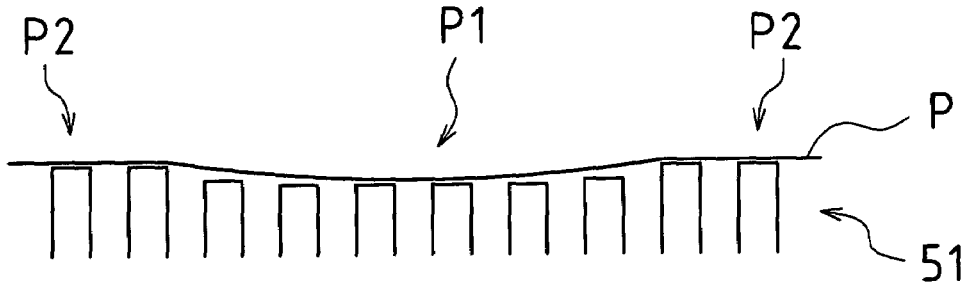
FIG. 4 is a drawing showing how a plurality of ribs formed on transfer medium guide means may be arranged thereon so as to occupy different heights in the transfer medium thickness direction.
Figure 4:
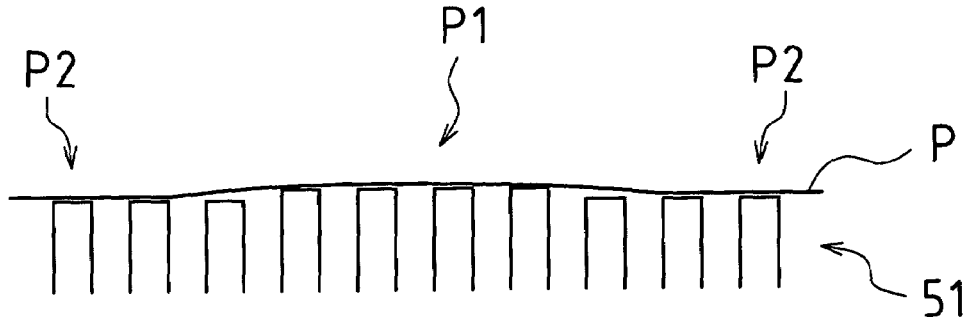

Note that the plurality of ribs formed on transfer medium guide means 51 need not be arranged uniformly in single file across the width as determined by the size of transfer medium P, but may, as shown for example in FIG. 4, be arranged such that the locations thereof are different at central portion P1 of transfer medium P and at end portions P2, P2 at either end of transfer medium P. That is, the plurality of ribs may be provided at locations corresponding to a region in the vicinity of the central portion of and to regions in the vicinities of each of the two ends in the width direction as determined by the size of the transfer medium; and the plurality of ribs may be arranged so as to occupy different heights in the transfer medium thickness direction.

For example, these may, as shown at FIG. 4 (*a*), be arranged such that central portion P1 of transfer medium P is lower than end portions P2, P2 at either end thereof; or conversely, these may, as shown at FIG. 4 (*b*), be arranged such that central portion PI of transfer medium P is higher than end portions P2, P2 at either end thereof. This makes it possible to achieve a constitution in which it is possible, by utilizing deflection (bowing) of transfer medium P as it passes through the aforementioned transfer region, to more easily guide and support transfer medium P along the full expanse thereof.

Moreover, in order to arrange the plurality of ribs so as to cause central portion P1 of transfer medium P to be lower than end portions P2, P2 at either end thereof, the location(s) at which rib(s) is/are installed at location(s) corresponding to central portion PI of transfer medium P and the location(s) at which rib(s) is/are installed at location(s) not corresponding to central portion PI of transfer medium P are varied. Furthermore, utilizing the effect of transfer medium P when acted upon by its own weight, locations may be provided at which rib(s) is/are deliberately not provided so as to impart stiffness to transfer medium P in corrugated fashion. And when the plurality of ribs are to be arranged so as to cause central portion P1 of transfer medium P to be higher than end portions P2, P2 at either end thereof, this may be carried out in similar fashion.

Moreover, with respect to the material(s) used for transfer medium guide means 51, it is preferred that electrically conductive member(s) be used, or more preferably that at least the portion thereof which rubs against transfer medium P be subjected to treatment (coating or the like) for achieving electrical conductivity thereat. This will make it possible to stably guide and support transfer medium P without accumulation of charge at transfer medium guide means 51 due to friction between same and the back surface of transfer medium P, and will make it possible to prevent adverse effect on the development image which is electrostatically supported on transfer medium P as a result of accumulation of charge.

Furthermore, resin material(s) having triboelectric characteristics identical to the toner charge polarity may be employed as material(s) for transfer medium guide means 51, in which case it will be possible to prevent toner from electrostatically adhering to transfer medium guide means 51 and it will be possible to prevent soiling of the back of transfer medium P.

Figure 5:
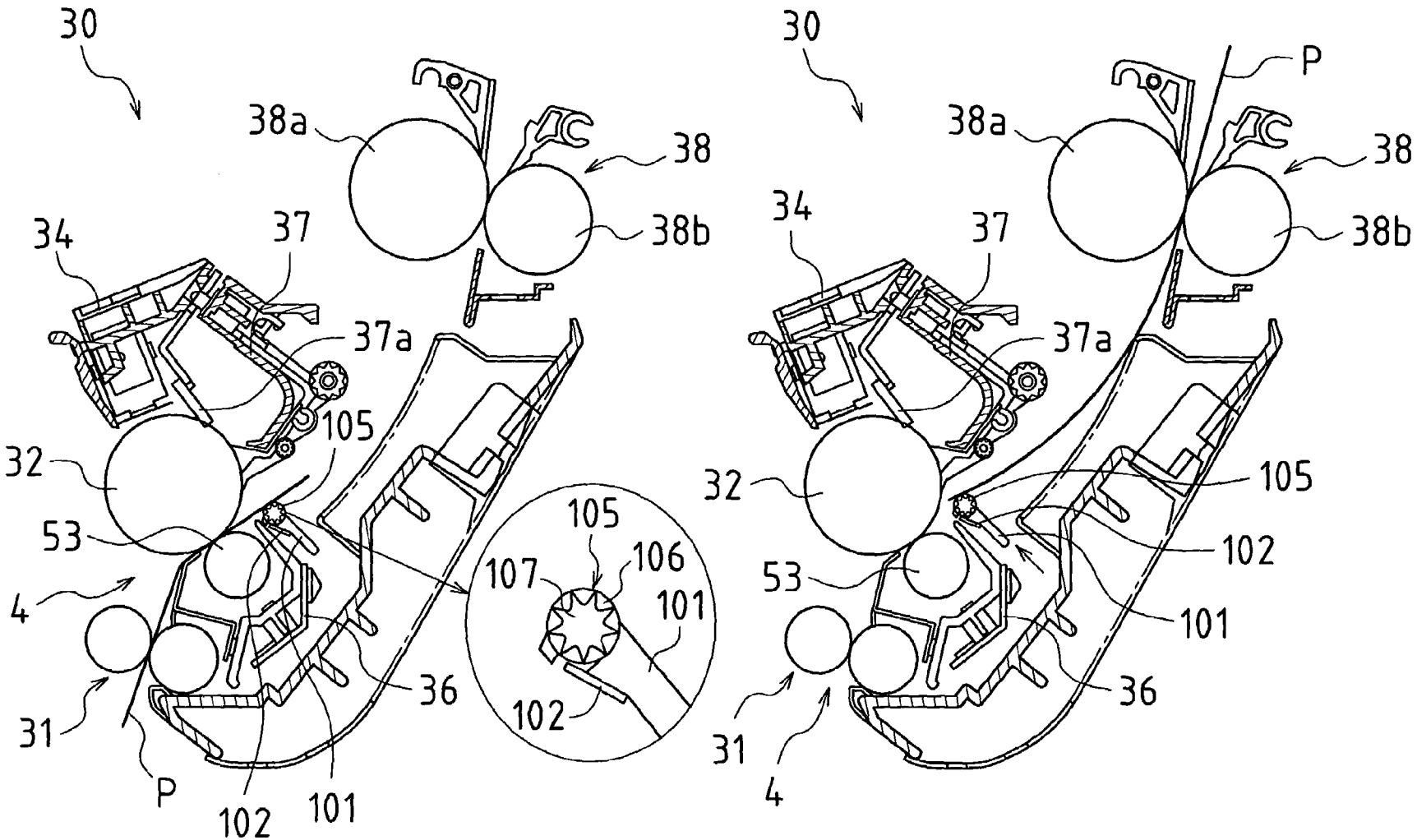
FIG. 5 is an enlarged sectional view of the principal parts in the vicinity of a different transfer apparatus associated with an embodiment of the present invention.

Referring to FIG. 5, another embodiment of the transfer medium guide means of the present invention will next be described. In the present embodiment, guide wheel(s) 105 is/are provided on transfer medium guide means 101 at region(s) thereof coming in contact with transfer medium P. As was the case with transfer medium guide means 51 described above, transfer medium guide means 101 of the present embodiment is such that the transfer medium guide location thereof can be selectively switched by guide location altering means so as to move back and forth between a first position (the position shown at FIG. 5 (*a*)) and a second position (the position shown at FIG. 5 (*b*)).

Guide wheel 105 comprises rotating body/bodies capable of rotation about axis/axes substantially parallel to the transfer medium P width direction, which is perpendicular to the transfer medium P transport direction. Accordingly, due to the fact that guide wheel 105, when it presses against the back surface of transfer medium P, rotates in idler fashion in coordination with downstreamwardly directed transport of transfer medium P in the transport path, it is possible to achieve a situation in which friction between same and transfer medium P is low, permitting transfer medium P to be smoothly guided and supported toward fusing apparatus 38 which is downstream therefrom.

Figure 6:
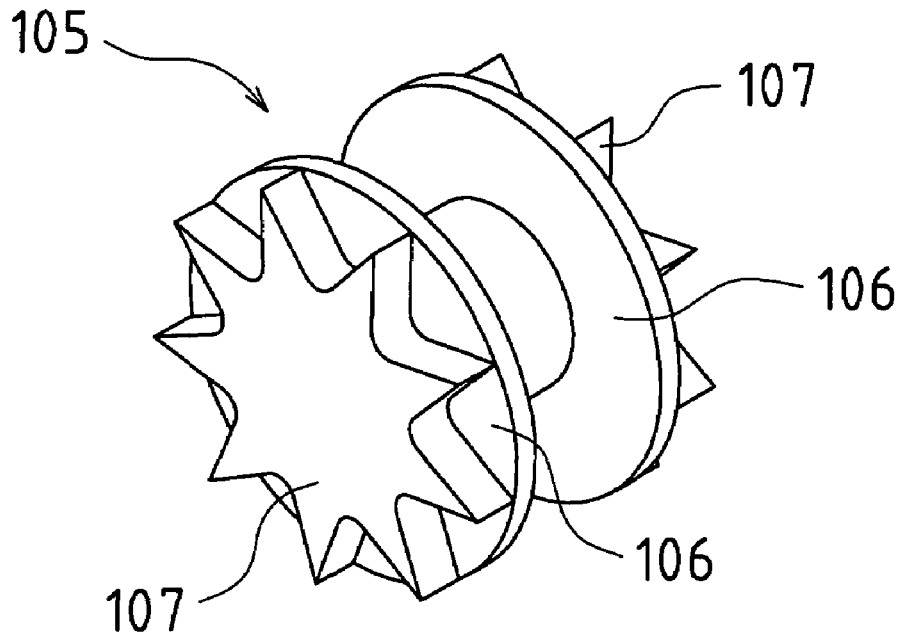
FIG. 6 is an oblique view showing a guide wheel comprising a first rotating body and a second rotating body.

Also, as shown in the enlarged inset at FIG. 5 (*a*) and in the oblique view of FIG. 6, guide wheel 105 comprises first rotating body/bodies 106 which is/are disk-shaped and second rotating body/bodies 107 which has/have star-shaped cross-sectional profile perpendicularly with respect to the rotatable shaft; first rotating body 106 and second rotating body 107 being formed in mutually integral fashion so as to be capable of rotation in tandem. Moreover, guide wheel 105 is provided with two first rotating bodies 106, 106 and two second rotating bodies 107, 107.

By thus forming second rotating body 107 in star-shaped fashion, engagement of the lead edge portion of transfer medium P and so forth by recess(es) between cuspate projections is facilitated. Moreover, rotation of guide wheel 105 may be encouraged by the cuspate projections, as will be described below. Note that second rotating body 107 is not limited to having star-shaped cross-sectional profile perpendicularly with respect to the rotatable shaft, it being possible, for example, for this to be polygonal such that there are a plurality of cuspate projections along the circumference thereof. Furthermore, second rotating body 107 may be formed from combination of planar members respectively intersecting at the center of the rotatable shaft such as would be the case where cross-sectional profile perpendicular to the rotatable shaft is cross-shaped and/or asterisk-shaped. That is, it is sufficient that second rotating body 107 have a plurality of cuspate features in cross-sectional profile perpendicularly with respect to the rotatable shaft. Furthermore, first rotating body 106 is not limited to disk-shaped components, it being possible to employ cylindrical components having finite thickness as same.

The present embodiment is constituted such that the outer rim of first rotating body 106 and the outer rim of second rotating body 107 (i.e., the outer rim of an imaginary circle circumscribing second rotating body 107) more or less coincide (i.e., diameters and/or outer shapes thereof in cross-sectional direction more or less coincide), the cuspate portions of the second rotating body appearing to be more or less circumscribed by the outer circumferential portion of the first rotating body when guide wheel 105 is viewed in the direction of the rotatable shaft. In other words, the diameter of the outer circumference of first rotating body 106 is approximately equal to the diameter of the imaginary circle circumscribing second rotating body 107. Moreover, in embodiments in which guide wheel 105 is such that second rotating body/bodies 107 is/are provided between first rotating body/bodies 106, because engagement of the lead edge portion of transfer medium P between cuspate portions of second rotating body 107 could be hindered if the cuspate portions of second rotating body 107 are more inwardly disposed than the outer rim of first rotating body 106, it is desirable that the cuspate portions of second rotating body 107 be made to protrude outwardly beyond the outer rim of first rotating body 106.

Furthermore, first rotating body/bodies 106 and second rotating body/bodies 107 may respectively comprise separate components which are mutually engaged and/or mated in integral fashion to constitute guide wheel 105, or guide wheel 105 may be constituted in integral fashion such that it includes first rotating body/bodies 106 and second rotating body/bodies 107.

Guiding action of guide wheel 105 will next be described. When the lead edge portion of transfer medium P reaches guide wheel 105 after having passed through the location (transfer region) at which photosensitive drum 32 opposes transfer roller 53, the lead edge portion of transfer medium P comes in contact with (abuts) cuspate portion(s) of second rotating body 107 such that guide wheel 105 rotates in idler fashion, with first rotating body 106 also rotating integrally therewith. Accordingly, guide wheel 105 rotates in correspondence to abutment of guide wheel 105 by the lead edge portion of transfer medium P as it is transported therethrough. At such time, transfer medium guide means 101 is in its first position (the position shown at FIG. 5 (*a*)). Transfer medium P then advances further along the transport path; and when the trail edge portion of transfer medium P passes through the transfer region, the cuspate portions of second rotating body 107 having acted on the back surface of transfer medium P, the transfer medium guide location of transfer medium guide means 101 is switched to its second position (the position shown at FIG. 5 (*b*)). In addition, as guide wheel 105 rotates it guides transfer medium P until the trail edge portion of transfer medium P emerges from transfer apparatus 36. At this time, the trail edge portion of transfer medium P being pushed upward by transfer medium guide means 101, the trail edge portion of transfer medium P does not come in contact with transfer roller 53.

Reasons why guide wheel 105 might in the present case be made to comprise both first rotating body/bodies 106 and second rotating body/bodies 107 are now described. If, for example, guide wheel 105 is constituted only from first rotating body/bodies 106 such that there is no second rotating body thereat, depending upon material(s) used for transfer medium P, transport speed(s), material(s) used for first rotating body 106, humidity, and so forth it is possible when the lead edge portion of transfer medium P abuts the edge portion at the outer rim of first rotating body 106 that there may be situations in which first rotating body 106 rotates and situations in which first rotating body 106 does not rotate.

If guide wheel 105 were to fail to rotate, there would be increased friction between transfer medium P and first rotating body 106, and there would be occurrence of the problematic situation in which rubbing of transfer medium P and accumulation of charge causes disruption of the toner image. Furthermore, wear of first rotating body 106 will cause alteration in the positional relationship, e.g., angle, at which guide wheel 105 carries out guiding, making it impossible to achieve stable guiding operations; and moreover, it is also conceivable that a problematic situation could arise in which noise is produced due to friction at transfer medium P, first rotating body 106, and/or the like. Furthermore, even where guide wheel 105 can be made to rotate, as it will be necessary to carry out testing with respect to material(s), dimension(s), surface condition(s), placement, and so forth of guide wheel 105 such as will permit definitive rotation of guide wheel 105 regardless of humidity and/or type of transfer medium P while allowing for a finite safety margin, the degrees of freedom would be reduced with respect to design thereof.

Conversely, if guide wheel 105 is constituted only from star-shaped second rotating body/bodies 107, while it will be relatively easy, there being little friction produced thereat, to cause guide wheel 105 to rotate when the lead edge portion of transfer medium P, being transported thereto, abuts cuspate portion(s) of second rotating body 107, this will invite problems in that if the lead edge portion of transfer medium P were to enter the space(s) between cuspate projections it is possible that the lead edge portion of transfer medium P could be bent, that paper jam(s) could occur, and/or that the toner image on transfer medium P could be disrupted.

In contrast hereto, the fact that the present embodiment is constituted such that first rotating body 106 and second rotating body 107 can rotate in tandem permits easy rotation thereof, there being little friction produced thereat, and allows first rotating body 106 to display remarkable effect in preventing transfer medium P from entering the recess(es) between cuspate portions of second rotating body 107—and this despite the fact that this is achieved in the context of a simple constitution.

That is, a situation whereby sliding motion on guide wheel 105 would otherwise be concentrated at particular location(s) is prevented, and damage which would otherwise be imparted to transfer medium P due to sliding motion is prevented. Furthermore, even if the transport direction of transfer medium P as it passes through the aforementioned transfer region is allowed to vary somewhat, problems whereby paper jams would otherwise be invited as a result of undesirable stiffness having been imparted to transfer medium P are eliminated. Moreover, because guide wheel 105 rotates, it is possible to minimize friction between same and transfer medium P; and it is also possible to avoid problematic situations in which unwanted triboelectric action is invited, with adverse effect on transfer operations and/or the like. Also, because friction is not concentrated at particular location(s) on guide member(s), it is possible to quite spectacularly eliminate a variety of problems such as the problem of instability in guide operations due to wear of guide member(s), the problem of wasteful replacement of guide member(s), the problem whereby powder produced by wear and paper dust that has been scattered about and/or the like is able contaminate the interior of apparatus(es) and lead to interference with transfer operations, and so forth.

Note that whereas guide wheel 105 of the present embodiment is such that first rotating bodies 106 and second rotating bodies 107 are respectively provided at two locations each as shown in FIG. 6, the present invention is not limited hereto; it being possible, for example, to provide first rotating body 106 at two locations and to provide second rotating body 107 at one location; i.e., a mutually different number of each may be provided. But note however, here, that since it is often the case that transfer medium P is transported in bent fashion, rather than arranging second rotating body/bodies 107 such that it/they is/are straddled by first rotating body/bodies, providing second rotating body/bodies such that it/they is/are to the side(s) in the direction of the axis of guide wheel 105 will make it easier for cuspate portion(s) of second rotating body/bodies to come in contact with transfer medium P and facilitate rotation of guide wheel 105.

Furthermore, as charge removal apparatus 102, which removes residual charge from the back surface of transfer medium P following transfer operation(s), is arranged between transfer roller 53 and transfer medium guide means 101, it is possible to achieve a situation in which distance to the tip portion of charge removal apparatus 102 from transfer medium P as it is guided by transfer medium guide means 101 remains constant, making it possible for charge remaining on transfer medium P to be uniformly removed over the entire expanse thereof.

In correspondence to the width dimension (width of transfer medium in direction perpendicular to direction of transport of transfer medium P) as determined by the size of transfer medium P which is transported therethrough, there are a plurality of such guide wheels 105, the plurality of guide wheels 105 being arranged in a direction parallel to the width dimension as determined by the size of this transfer medium P so as to permit transfer medium P to be definitively guided and supported regardless of the width dimension of transfer medium P as determined by the size thereof.

Note that guide wheels 105 need not be arranged uniformly in single file across the width as determined by the size of transfer medium P, but may, as was the case with transfer medium guide means 51 of the foregoing embodiment (see FIG. 4), be arranged such that the locations thereof are different at the central portion of transfer medium P and at the end portions at either end of transfer medium P. That is, guide wheels 105 may be provided at locations corresponding to a region in the vicinity of the central portion of and to regions in the vicinities of each of the two ends in the width direction as determined by the size of the transfer medium; and guide wheels 105 may be arranged so as to occupy different heights in the transfer medium thickness direction.

For example, these may be arranged such that the central portion of transfer medium P is lower than the end portions at either end thereof; or conversely, these may be arranged such that the central portion of transfer medium P is higher than the end portions at either end thereof. This makes it possible to achieve a constitution in which it is possible, by utilizing deflection (bowing) of transfer medium P as it passes through the location (transfer region) at which photosensitive drum 32 opposes transfer roller 53, to more easily guide and support transfer medium P along the full expanse thereof.

Moreover, in order to arrange the respective guide wheels 105 so as to cause the central portion of transfer medium P to be lower than the end portions at either end thereof, the locations at which guide wheel(s) 105 is/are installed at location(s) corresponding to the central portion of transfer medium P and the locations at which guide wheel(s) 105 is/are installed at location(s) not corresponding to the central portion of transfer medium P are varied. Furthermore, utilizing the effect of transfer medium P when acted upon by its own weight, locations may be provided at which guide wheel(s) 105 is/are deliberately not provided so as to impart stiffness to transfer medium P in corrugated fashion. And when the guide wheels 105 are to be arranged so as to cause the central portion of transfer medium P to be higher than the end portions at either end thereof, this may be carried out in similar fashion.

Moreover, substance(s) such as POM (polyoxymethylene) which is tough and has mechanical properties comparable to metal may be favorably used as material(s) for guide wheel(s) 105; surface(s) thereof may be coated with carbon and/or other such electrically conductive material(s), and carbon and/or other such electrically conductive material(s) may be added to POM. This will make it possible to stably guide and support transfer medium P without accumulation of charge at guide wheel(s) 105 due to abutment between same and the back surface of transfer medium P, and will make it possible to prevent adverse effect on the development image which is electrostatically supported on transfer medium P as a result of accumulation of charge.

Furthermore, where guide wheel(s) 105 and charge removal apparatus 102 are disposed in mutual proximity, being arranged in such fashion that there is a possibility that voltage applied to charge removal apparatus 102 will leak onto transfer medium P by way of guide wheel(s) 105, it is possible by forming guide wheel(s) 105 from insulator material(s) (e.g., insulating resin material(s)) to prevent leakage of charge removal voltage such that there is no effect of this charge removal on transfer medium P following separation thereof, and to therefore prevent adverse effect on the development image which is electrostatically supported on transfer medium P.

Furthermore, in such case, by employing resin material(s) having triboelectric characteristics identical to the toner charge polarity as material(s) for guide wheel(s) 105, it is possible to achieve a situation which is such that, even if charge accumulates at guide wheel(s) 105 due to abutment between same and the back surface of transfer medium P, because the charge polarity thereof will be the same as that of the toner, toner will not be made to adhere electrostatically thereto and it will therefore be possible to carry out satisfactory image formation without soiling of the back of transfer medium P.

Moreover, while the foregoing embodiments have been described in terms of examples in which transfer roller 53 was employed as transfer body at transfer apparatus 36, similar effect may be obtained where transfer block(s), transfer brush(es), and/or other such transfer body/bodies is/are provided so as to press against and/or so as to be brought in proximity to surface(s) of photosensitive drum(s) 32. In particular, by providing transfer medium guide means 51 (101) downstream in the transport path from the location (transfer region) at which photosensitive drum 32 opposes the transfer body/bodies and by causing the trail edge portion of transfer medium P to move away from surface(s) of transfer body/bodies, it is possible to obtain quite spectacular effect with respect to prevention of situations in which toner from unfused toner image(s) transferred to transfer medium/media P adheres to transfer body/bodies and migrates to the trail edge portion of subsequent transfer medium/media P, causing soiling thereof due to toner adhering thereto.

Moreover, the present invention may be embodied in a wide variety of forms other than those presented herein without departing from the spirit or essential characteristics thereof. The foregoing embodiments and working examples, therefore, are in all respects merely illustrative and are not to be construed in limiting fashion. The scope of the present invention being as indicated by the claims, it is not to be constrained in any way whatsoever by the body of the specification. All modifications and changes within the range of equivalents of the claims are, moreover, within the scope of the present invention.

What is claimed is:

1. An image forming apparatus comprising:

one or more transfer means having one or more transfer bodies electrostatically transferring one or more development images from one or more image carriers to one or more transfer media; and one or more transfer medium guide means disposed downstream in at least one transfer medium transport path from one or more locations at which at least one of the image carrier or carriers opposes at least one of the transfer body or bodies;

wherein at least one transfer medium guide location of at least one of the transfer medium guide means is variable to cause a position of the trail edge portion of said one or more transfer media to be variable, such that the trail edge portion of said one or more transfer media is caused to move away from said one or more transfer means, wherein at least one of the transfer medium guide means is capable of being selectively switched between a first position permitting at least one lead edge portion of at least one of the transfer medium or media to be guided therealong when the at least one transfer medium lead edge portion passes therethrough and a second position permitting said at least one trail edge portion of at least one of the transfer medium or media to be raised upward when the at least one transfer medium trail edge portion passes therethrough, and wherein when the position of the transfer medium is shifted the position of the transfer medium is variable in a substantially parallel manner toward the image carrier.

2. An image forming apparatus according to claim, further comprising:

one or more fusing means, disposed downstream in at least one transport path from at least one of the transfer medium guide means, for fusing at least one of the development image or images electrostatically transferred to at least one of the transfer medium or media;

wherein switching from the first position of at least one of the transfer medium guide location or locations of at least one of the transfer medium guide means to the second position thereof takes place after at least the lead edge portion of at least one of the transfer medium or media enters at least one of the fusing means.

3. An image forming apparatus according to claim 1 wherein at least one of the transfer medium guide means is equipped with one or more charge removal means for removing charge from at least one of the transfer medium or media.

4. An image forming apparatus according to claim 1 wherein at least one of the transfer medium guide means is such that one or more ribs are formed thereon at least at one or more regions coming in contact with at least one of the transfer medium or media.

5. An image forming apparatus according to claim 4 wherein, in correspondence to at least one width of at least one of the transfer medium or media in at least one direction perpendicular to at least one direction of transport of at least one of the transfer medium or media, a plurality of ribs is formed on at least one of the transfer medium guide means, at least a portion of the plurality of ribs being arranged along one or more directions parallel to at least one width direction of at least one of the transfer medium or media.

6. An image forming apparatus according to claim 5 wherein:

at least a portion of the plurality of ribs formed on at least one of the transfer medium guide means are provided at locations corresponding to at least one region in the vicinity of the central portion of, and at least one region in the vicinity of each of the two ends in at least one width direction of, at least one of the transfer medium or media; and at least a portion of the plurality of ribs are arranged so as to occupy different heights in at least one transfer medium thickness direction.

7. An image forming apparatus according to claim 1 wherein at least one of the transfer medium guide means is such that at least one or more regions coming in contact with at least one of the transfer medium or media is or are formed from one or more electrically conductive materials.

8. An image forming apparatus according to claim 1 wherein at least one of the transfer medium guide means is such that at least one or more regions coming in contact with at least one of the transfer medium or media is or are formed from one or more resin materials having triboelectric characteristics substantially identical to at least one charge polarity of at least one of the developer or developers.

9. An image forming apparatus according to claim 1 wherein at least one of the transfer medium guide means has, at one or more locations coming in contact with at least one of the transfer medium or media, at least one rotating body capable of rotation about at least one axis substantially parallel to at least one transfer medium width direction perpendicular to at least one transfer medium transport direction.

10. An image forming apparatus according to claim 9 wherein at least one of the rotating body or bodies comprises:

one or more disk-shaped first rotating bodies; and one or more second rotating bodies having a plurality of cuspate features present in at least one cross-sectional profile in at least one direction perpendicular to at least one rotatable shaft;

wherein at least one of the first rotating body or bodies and at least one of the second rotating body or bodies are rotatable;

are formed in integral fashion; and are capable of rotation about at least one axis substantially parallel to at least one transfer medium width direction perpendicular to at least one transfer medium transport direction.

11. An image forming apparatus according to claim 9 wherein, in correspondence to at least one width of at least one of the transfer medium or media in at least one direction perpendicular to at least one direction of transport of at least one of the transfer medium or media, a plurality of the rotating bodies is arranged along one or more directions parallel to at least one width direction of at least one of the transfer medium or media.

12. An image forming apparatus according to claim 11 wherein:

at least a portion of the plurality of rotating bodies are provided at locations corresponding to at least one region in the vicinity of the central portion of, and at least one region in the vicinity of each of the two ends in at least one width direction of, at least one of the transfer medium or media; and at least a portion of the plurality of rotating bodies are arranged so as to occupy different heights in at least one transfer medium thickness direction.

13. An image forming apparatus according to claim 9 wherein at least one of the rotating body or bodies is formed from one or more electrically conductive materials.

14. An image forming apparatus according to claim 9 wherein:

at least one of the transfer medium guide means is equipped with one or more charge removal means for removing charge from at least one of the transfer medium or media; and at least one of the rotating body or bodies is formed from one or more insulating resin materials.

15. An image forming apparatus according to claim 9 wherein at least one of the rotating body or bodies is formed from one or more resin materials having triboelectric characteristics substantially identical to at least one charge polarity of at least one of the developer or developers.

16. An image forming apparatus according to claim 1 wherein said one or more transfer bodies are one or more transfer rollers that press against said one or more image carriers.

* * * * *